US006872257B2

(12) United States Patent
Martens et al.

(10) Patent No.: US 6,872,257 B2
(45) Date of Patent: Mar. 29, 2005

(54) PRESSURIZED CHAMBER DOCTOR BLADE

(75) Inventors: Bernd Martens, Uetersen (DE); Sadan Deral, Winsen/Luhe (DE); Wolfram Szczepaniak, Stelle (DE); Nils Hansen, Seevetal (DE)

(73) Assignee: Maschinenfabrik Max Kroenert GmbH & Co., Hamburg (DE)

( * ) Notice: Subject to any disclaimer, the term of this patent is extended or adjusted under 35 U.S.C. 154(b) by 0 days.

(21) Appl. No.: 10/233,162

(22) Filed: Aug. 30, 2002

(65) Prior Publication Data

US 2003/0084842 A1 May 8, 2003

(30) Foreign Application Priority Data

Sep. 3, 2001 (DE) ..... 101 43 077

(51) Int. Cl.[7] ..... B05C 3/02
(52) U.S. Cl. ..... 118/413; 118/261
(58) Field of Search ..... 118/413, 261, 118/419; 101/366, 365

(56) References Cited

U.S. PATENT DOCUMENTS

| | | | | |
|---|---|---|---|---|
| 4,261,286 A | | 4/1981 | Kupfer | 118/202 |
| 4,688,516 A | * | 8/1987 | Sommer | |
| 4,903,632 A | * | 2/1990 | Sollinger | |
| 5,497,702 A | * | 3/1996 | Gorter | |
| 5,599,392 A | * | 2/1997 | Liang et al. | |
| 5,824,369 A | * | 10/1998 | Li et al. | |
| 6,579,368 B1 | * | 6/2003 | Kohl et al. | |

FOREIGN PATENT DOCUMENTS

| | | |
|---|---|---|
| DE | 41 38 807 C1 | 6/1993 |
| DE | 299 17 979 U1 | 3/2000 |
| DE | 299 22 546 U1 | 3/2000 |

OTHER PUBLICATIONS

One page English Abstract from esp@cenet for DE 4138807, Jun. 1993.
One page English Abstract from esp@cenet for EP 1110728 which is a counterpart of DE 299 22 546 U1, Mar. 2000.

* cited by examiner

*Primary Examiner*—Brenda A. Lamb
(74) *Attorney, Agent, or Firm*—Howson and Howson

(57) ABSTRACT

The invention pertains to a pressure chamber scraper for application of a liquid medium onto a rotating drum, said pressure chamber scraper having an axially extending scraper head, that together with an axially extending dosing scraper touching the mantle surface of the drum and with a sealing scraper forms a chamber in the circumferential direction, in said chamber there is an axially extending displacement element to form a pressure compartment and an outlet compartment and leaving an application gap to the mantle surface of the drum, and the liquid medium for wetting of the mantle surface flows through said gap, wherein the medium is supplied through an inlet opening into the pressure compartment. According to the invention, it is proposed that the displacement element and scraper head have mutually facing contact surfaces which bound at least one gap between them which opens into the pressure compartment and connects it to the inlet opening, so that the medium can move into the pressure compartment. With this kind of design it is possible to configure the gap as narrow as desired.

16 Claims, 3 Drawing Sheets

PRESSURIZED CHAMBER DOCTOR BLADE

FIELD OF THE INVENTION

The invention pertains to a pressure chamber scraper for application of a liquid medium onto a rotating drum, said pressure chamber scraper having an axially extending scraper head, that together with an axially extending dosing scraper touching the mantle surface of the drum and with a sealing scraper forms a chamber in the circumferential direction, in said chamber there is an axially extending displacement element to form a pressure compartment and an outlet compartment while leaving an application gap with respect to the mantle surface of the drum, and the liquid medium for wetting of the mantle surface flows through said gap, wherein the medium is supplied through an inlet opening into the pressure compartment.

BACKGROUND OF THE INVENTION

A pressure chamber scraper of this kind is known, for example, from DE 299 17 979.6 U1. This document describes that the displacement element is lowered into a recess of the chamber and is screwed to the scraper head. Setscrews are provided for changing the distance between the displacement element and the drum. In the known pressure chamber scraper the medium to be applied is introduced into the pressure compartment through lateral openings in the displacement element, so that a homogeneous distribution of the medium across the axial length of the pressure compartment and thus in the application gap will result. However, a pressure compartment of this kind is relatively difficult to clean when changing the application medium or in case of an interruption in operation. In particular, a partially tacky and highly viscous medium settles onto the threads of the screw connections and hardens there, and it can only be removed with much difficulty or only with the use of aggressive solvents. Also, the openings can quickly plug up.

It turns out that in the case of these pressure chamber scrapers a particularly homogeneous distribution of the medium in the application gap and a targeted volume dosing are dependent in particular on the size of the openings in the displacement element. Tight openings with a high throttle effect are particularly useful, so that when working with only one or up to three openings, the medium can be supplied uniformly into the pressure compartment and to the application gap. However, the manufacture of these tight openings in the displacement element is subject to certain limitations. Firstly, a longitudinal slit with a slit dimension of less than 2 mm cannot be manufactured in an economical manner. And secondly, this kind of narrow opening cannot be cleaned when necessary.

OBJECTS OF THE INVENTION

Nonetheless, it is desirable to provide the tightest possible opening in the displacement element. Therefore, the invention is based on the problem of designing a pressure chamber scraper of the kind described above, so that the medium can be supplied through the tightest possible opening into the pressure compartment. Furthermore, the displacement element should be easy to clean and easy to assemble.

SUMMARY OF THE INVENTION

The problem is solved according to this invention in that the displacement element and scraper head have mutually facing contact surfaces which bound at least one gap between them which opens into the pressure compartment and connects it to the inlet opening, so that the medium can move into the pressure compartment.

The medium thus flows from at least one inlet channel through the displacement element and the gap, into the pressure compartment. With this kind of design it is possible to configure the gap as narrow as desired.

In this regard, it is possible to design the invention so that the at least one gap is formed by a recess in one contact surface of the displacement element and/or in a corresponding contact surface of the scraper head. A recess of this kind can be created by simple means and at a small depth, so that in the assembled state, a gap of small inside dimensions will be produced.

It is also possible for at least one gap to be formed by spacer elements which are placed between the corresponding contact surfaces of the displacement element and scraper head. These spacer elements can be manufactured to be very thin and designed to fit so that they will define the size of the gap, and the two features will ensure an inside dimension of the gap in the assembled state of less than 2.0 mm, and preferably less than 1.0 mm.

It is possible for the gap to extend nearly across the entire axial length of the chamber and be interrupted solely by contact regions of the displacement element on the scraper head. In the case of displacement elements of little width, the contact regions can be provided only at the axial ends of the displacement element. In the case of larger widths, contact regions in the middle region can also be useful, so that the displacement element will run exactly parallel and across the entire axial length with the same spacing from the surface of the drum.

The inlet opening opens into the displacement element in front of the gap. It is useful for the inlet opening to be composed of an axial recess in the displacement element and/or scraper head from which the gap emanates. This has the advantage that in the case of only one central inlet of the medium into the displacement element, a distribution of the medium will occur in the axial direction just before its inlet into the pressure compartment. The medium will stagnate across the entire length in front of the narrow gap and can enter uniformly into the pressure compartment. In addition, it is useful for the gap to run essentially tangential to the drum.

The invention also pertains to a pressure chamber scraper with a particularly easy to assemble displacement element. Thus according to the invention, the displacement element is equipped on its side facing the scraper head with back-cut grooves which adjoin an insertion opening and into which bolts with correspondingly thickened ends will engage and which are seated in the scraper head transverse to the back cut and can move back and forth therein and can be locked in place by at least one tensioning device in order to tension the displacement element with the scraper head. Thus, a secure attachment of the displacement element is possible without screw connections in the vicinity of the chamber. Furthermore, with this feature, a much faster assembly of the displacement element is possible, in a favorable manner, since no screw connections in the chamber have to be loosened.

According to one preferred design embodiment of the invention, the bolts extend through the scraper head and the tensioning devices are located on the side of the scraper head facing away from the displacement element. Thus, a particularly easy assembly of the displacement element will be attained. In particular, the tensioning devices will always be easily accessible from beneath the scraper head, where they will also be shielded from the exiting medium.

The particular type of tensioning devices is essentially of no importance. Of course, bolts located on the side facing away from the displacement element can be tensioned with screws. But it turns out to be particularly useful for the tensioning devices to be operated by motor, hydraulically or pneumatically. This is also a favorable factor when the displacement element can be tensioned above the bolts along several axially spaced regions. Essentially it is useful if at these regions there is at least one bolt on the side of the pressure compartment and on the side of the outlet compartment.

The displacement element and scraper head contact each other along contact surfaces, and the displacement element can move back and forth on contact surfaces in at least one assembly direction, in particular parallel to the drum axis, in order to introduce the bolt and to move into the back-cuts. It can be provided that the bolts in the installed state will define the alignment of the displacement element relative to the drum. However, the displacement element has to be aligned very precisely with respect to the drum, in order to obtain the desired and defined flow conditions in the application gap. Therefore, it is useful if the displacement element can slide back and forth on the scraper head along guides in one assembly direction, which aligns the displacement element in the direction transverse to the assembly direction relative to the drum. In this case, the assembly direction runs preferably parallel to the drum axis, while the control devices cause a tangential alignment of the displacement element. Thus the necessarily precise alignment of the displacement element relative to the drum will be assured.

In addition, spacer elements can be provided which are located between displacement element and scraper head in order to vary the spacing of the displacement element from the drum. Thus, the pressure chamber scraper can be adapted to different viscous media and to different application thicknesses.

BRIEF DESCRIPTION OF THE DRAWINGS

The invention will be explained in greater detail below based on the schematic illustrations. We have.

DETAILED DESCRIPTION OF THE PREFERRED EMBODIMENT

Figure 1:
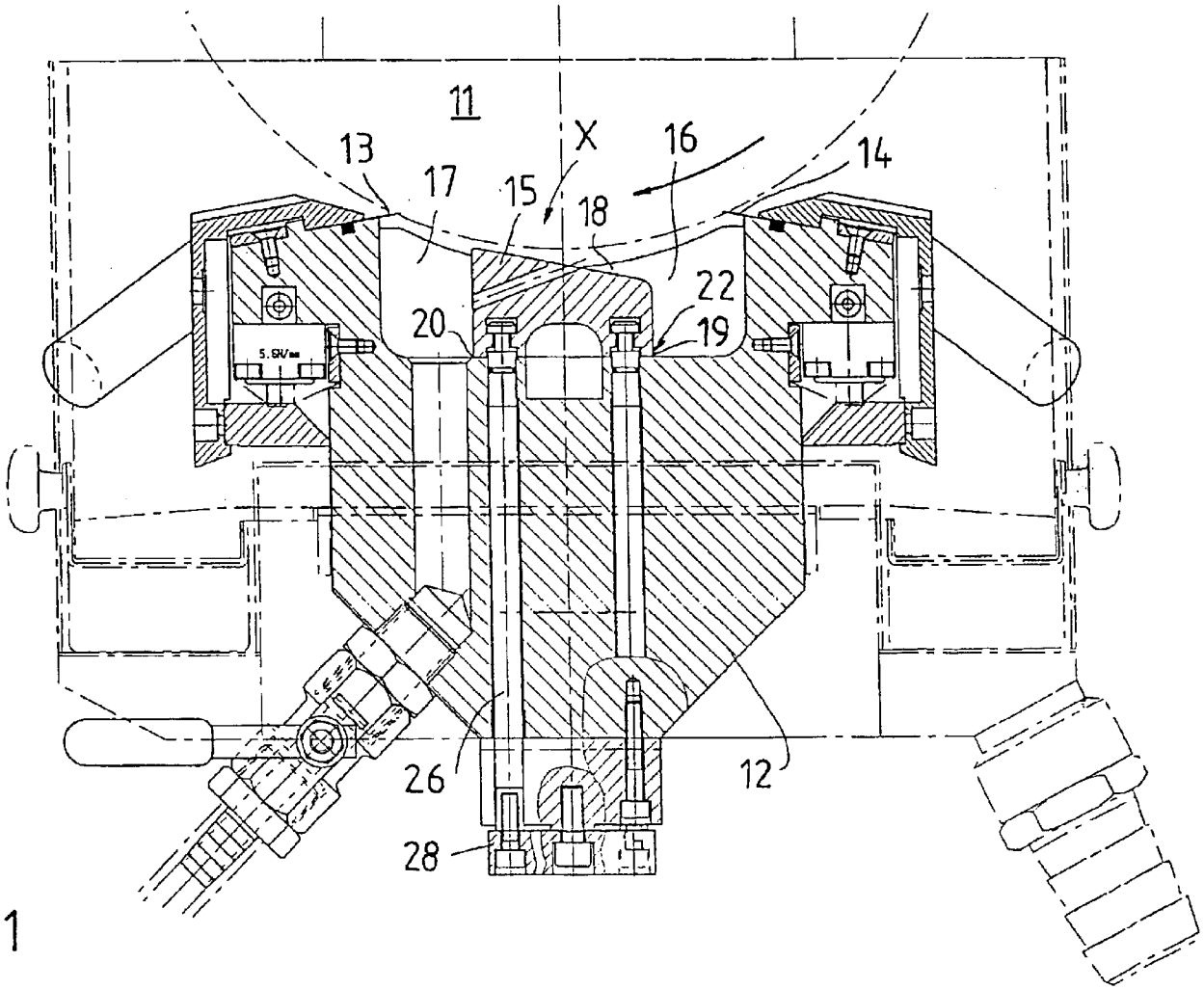
FIG. 1 A cross section through a pressure chamber scraper according to the invention FIG. 2 A detail X shown in enlarged presentation FIG. 3 A lower view of the displacement element in the area of the contact regions, and FIG. 4 A schematic, longitudinal view of the pressure chamber scraper, partially cut away.
Figure 3:
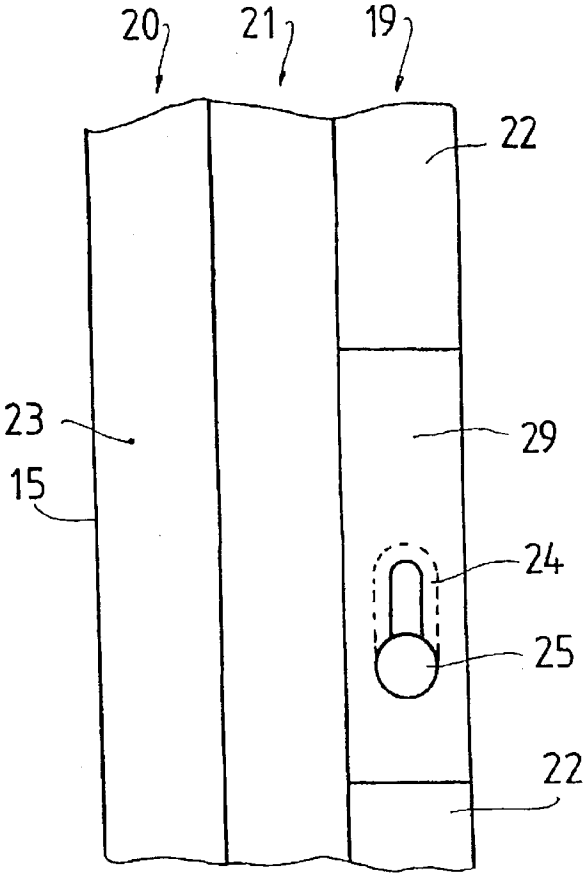
Figure 2:
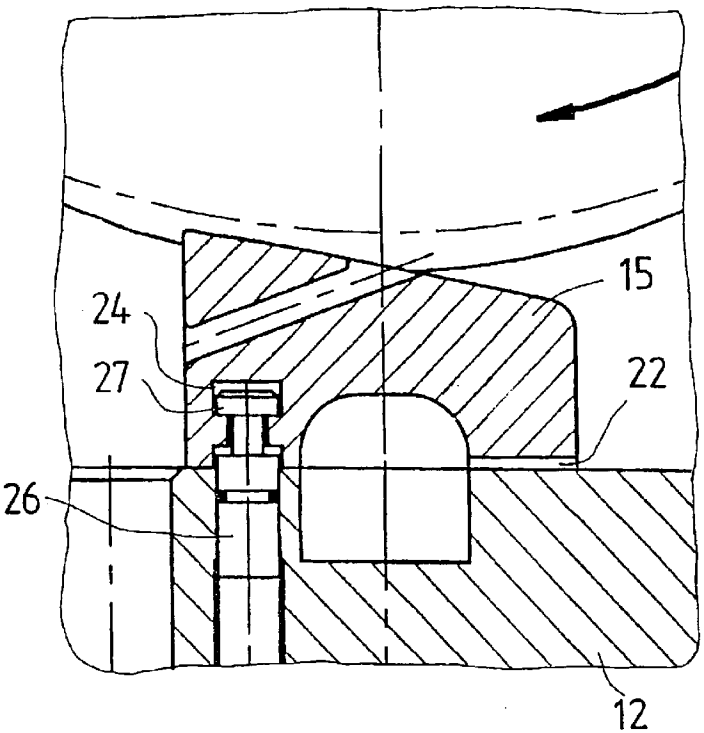

The pressure chamber scraper illustrated in the figures is located underneath a drum 11 in the so-called 6-o' clock position and extends in an axial direction parallel to the drum axis. The machine frame which supports the pressure chamber scraper and the drum 11, and also other drums and aggregates, has not been included in the figure for simplicity.

The pressure chamber scraper has a scraper head 12 and also a dosing scraper 13, and a sealing scraper 14 which rest against the surface of the drum and thus define a chamber. An axially extending displacement element 15 is provided which divides the chamber into a pressure compartment 16 and an outlet compartment 17, and between it and the drum an application gap 18 is created. The medium to be applied onto the drum moves through the displacement element 15 into the pressure compartment, flows through the application gap 18 and thus wets the drum, which, in turn, wets a sheet-like material or another drum. Any excess medium is removed by the dosing scraper 13 from the drum and moves into the outlet compartment 17, from where it is removed or returned or recycled back to the pressure compartment. To this extent, the pressure chamber scraper corresponds to a conventional pressure chamber scraper and requires no further explanation.

The displacement element 15 and the scraper head 12 are in mutual contact by means of the contact surfaces 19, 20. In particular, the design has been configured so that the scraper head 12 is essentially of a tub-like shape and has an essentially planar bottom with the contact surfaces. The contact surfaces 19, 20 run preferably in one plane. The contact surfaces extend axially on both sides of a central inlet opening 21 for the medium. In the assembled state, the contact surfaces 19, 20 of the displacement element 15 and of the scraper head 12 seal against each other. The displacement element and the scraper head between them bound at least one gap 22 on the pressure chamber side and the medium passes through the gap and the inlet opening 21 into the pressure compartment 16. This gap can be formed by recesses on the contact surface of the displacement element 15 or of the scraper head 12. Thus, any particular narrow gap can be formed. Nonetheless, cleaning is still simple, since when the device is disassembled, the boundary walls of the gap are easily accessible.

The gap 22 can extend across nearly the entire axial length of the pressure chamber scraper and can be bounded only at the end against the scraper head by contact regions of the displacement element. In the case of wide drums, however, it is useful to provide several axially spaced contact regions 29, in order to prevent flexure of the displacement element relative to the scraper head. The inlet opening 21 can be designed as an axially extending recess in the displacement element and/or scraper head, into which a central channel, or several inlet channels will open. The medium will thus stagnate in front of the gap 22 and move uniformly into the pressure compartment 16. Preferably the contact surfaces 19,20 of the scraper head and of the displacement element run essentially tangential to the drum, so that the gap likewise will open in a tangential direction into the pressure compartment. Thus, a homogeneous application of the medium onto the drum will be assured.

Figure 4:
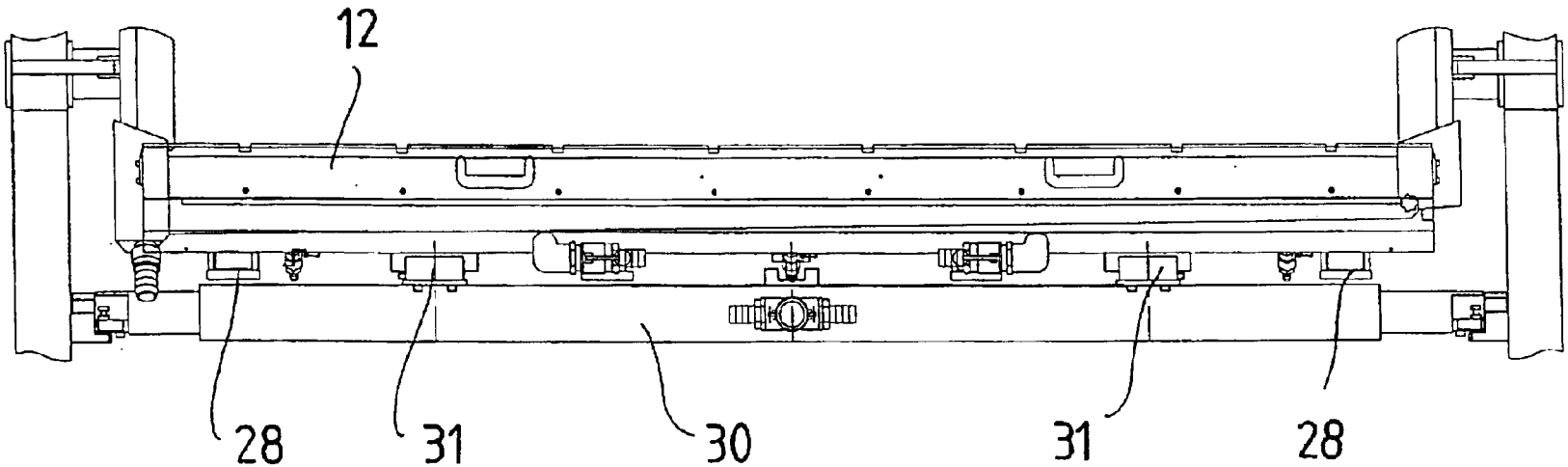

Basically, the entire pressure chamber scraper will experience a flexure when wider drums are used. As is known, a transverse beam can be located under the scraper head 12 which will compensate this flexure by means of a central setscrew. However, handling and adjustment of this setscrew is complicated. In FIG. 4 we see another placement of the scraper head 12 on just this kind of transverse beam 30. Two supports 31 are provided and they are located at a distance from the axial end of the pressure chamber scraper to support the scraper head. This spacing is defined so that a minimal flexure will result from the surface load acting on the scraper head. These spacing intervals can be calculated, and it is thus possible by simple means to create a relatively rigid structure with little flexure. The displacement element thus runs along its entire axial extension in a manner nearly parallel to the surface of the drum, so that the application gap always has the same inside gap width, so that a particularly uniform application of the medium will result. This kind of support is also possible for oscillating scraper heads. Here, the invention provides that the supports 31 are located along a linear guide underneath the scraper head and can move back and forth, and thus they can follow the axis-parallel motion of the scraper head. The load is acting essentially from above and will still be easily absorbed.

The displacement element 15 rests planar upon the bottom of the scraper head. On its underside 23 facing away from the scraper head there are back-cut grooves 24, which adjoin the inlet openings 25. Bolts 26 fit into these inlet openings and the bolts have correspondingly thickened or recessed ends 27 which engage in the back-cuts. The bolts 26 extend through the scraper head and are seated transverse to the back-cuts and can move therein. On the side of the scraper head facing away from the displacement element 15 the bolts 26 cooperate with hydraulic or pneumatic tension cylinders 28, which move the bolts downward and thus securely tension the displacement element 15 with the scraper head 12. For disassembly, the tension cylinders are loosened and the displacement element can be moved from the bolt guide and lifted up from the chamber. Thus, a fast and dependable assembly of the displacement element in the scraper head is possible. In addition, other guide features (not illustrated) can be used which lock the displacement element tangential to the drum and allow a movement only in the axial direction. The back-cut grooves are aligned accordingly. Thus, an exact positioning of the displacement element 15 will be assured to form the application gap 18. Preferably, the bolts and the associated grooves are located in the contact regions 29 of the displacement element 15 on the scraper head 12—at least on the pressure compartment side.

It is evident that with this kind of design of a pressure chamber scraper a significantly more simple assembly of the displacement element is possible. Also, no screw connections are used which can plug up with the medium and which would then be very difficult to clean. In particular, a very tight outlet gap for the medium into the pressure compartment can be created, so that an optimized dosing and homogeneous distribution of the medium will be possible.

What is claimed is:

1. Pressure chamber scraper for application of a liquid medium onto a rotating drum, said pressure chamber scraper having an axially extending scraper head (12), together with an axially extending dosing scraper (13) touching the mantle surface of the drum and with a sealing scraper (14) it forms a chamber in the circumferential direction, in said chamber there is an axially extending displacement element (15) to form a pressure compartment (16) and an outlet compartment (17) and leaving an application gap (18) to the mantle surface of the drum, and the medium for wetting of the mantle surface flows through said gap, wherein the medium is supplied through an inlet opening (21), located between the displacement element (15) and the scraper head (12), and into the pressure compartment (16), characterized in that the displacement element (15) and scraper head (12) have mutually facing contact surfaces (19, 20) which bound at least one gap (22) that is formed between the displacement element (15) and the scraper head (12), the at least one gap (22) opens into the pressure compartment (16) and provides the only path for the medium to flow directly from the inlet opening (21) into the pressure compartment (16).

2. Pressure chamber scraper according to claim 1, wherein the at least one gap (22) is formed by a recess in one contact surface (19, 20) of the displacement element (15) and corresponding contact surface (19, 20) of the scraper head (12).

3. Pressure chamber scraper according to claim 1, wherein the at least one gap is formed by spacer elements which are placed between the corresponding contact surfaces of the displacement element (15) and scraper head (13).

4. Pressure chamber scraper according claim 1, wherein the gap (22) extends nearly across the entire axial length of the chamber and is interrupted solely by contact regions of the displacement element (15) on the scraper head (12).

5. Pressure chamber scraper according to claim 1, wherein an inside dimension of the gap (22) when in the assembled state is less than 2.0 mm.

6. A pressure chamber scraper according to claim 5, wherein said inside dimension of the at least one gap (22) when in said assembled state is less than 1.0 mm.

7. Pressure chamber scraper according to claim 1, wherein the inlet opening (21) is an axial recess in at least one of the displacement element (15) and the scraper head (12) from which the gap (22) emanates.

8. Pressure chamber scraper according to claim 1, wherein the gap (22) runs essentially tangential to the drum (11).

9. Pressure chamber scraper for application of a liquid medium onto a rotating drum, said pressure chamber scraper having an axially extending scraper head (12), that together with an axially extending dosing scraper (13) touching the mantle surface of the drum and with a sealing scraper (14) forms a chamber in the circumferential direction, in said chamber there is an axially extending displacement element (15) to form a pressure compartment (16) and an outlet compartment (17) and leaving an application gap (18) to the mantle surface of the drum, and the medium for wetting of the mantle surface flows through said gap, wherein the medium is supplied through an inlet opening (21) into the pressure compartment, characterized in that the displacement element (15) is equipped on its side (23) facing the scraper head (12) with back-cut grooves (24) which adjoin an insertion opening (25) and into which bolts (26) with correspondingly thickened ends (27) will engage and which are seated in the scraper head (12) transverse to the back cut grooves (24) and can move back and forth therein and can be locked in place by at least one tensioning device (28) in order to tension the displacement element (15) with the scraper head (12).

10. Pressure chamber scraper according to claim 9, characterized in that the bolts (26) extend through the scraper head (12) and the tensioning devices are located on the side of the scraper head facing away from the displacement element (15).

11. Pressure chamber scraper according to claim 9, wherein the tensioning devices arc selected from the group consisting of a motor operated device, hydraulically operated device, pneumatically operated device, and tension screws.

12. Pressure chamber scraper according to claim 9, wherein the displacement element (15) is tensioned via the bolts at several axially spaced regions along the displacement element (15), one of said regions include a side adjacent to the pressure compartment and another one of said regions having a side adjacent to the outlet compartment, wherein said regions have at least one of the bolts in the region having a side adjacent to the pressure compartment and in the region having a side adjacent to the outlet compartment.

13. Pressure chamber scraper according to claim 9, wherein the displacement element is movable back and forth on contact surfaces of the scraper head (12) in at least one assembly direction to introduce and position the bolts into the back-cut grooves (24).

14. Pressure chamber scraper according to claim 13, characterized in that the displacement element can slide back and forth on the scraper head along guides in one said assembly direction parallel to longitudinal axis of the drum, which aligns the displacement element in the direction transverse to one said assembly direction.

15. A pressure chamber scraper according to claim 13, wherein the displacement element (15) is movable back and forth on the contact surfaces in a direction parallel to the drum axis for purposes of introducing and positioning the bolts into the back-cut grooves (24).

16. Pressure chamber scraper according to claim 9, wherein spacer elements are provided which are located between the displacement element (15) and the scraper head (12) to vary the distance between the displacement element and the drum.

* * * * *

UNITED STATES PATENT AND TRADEMARK OFFICE

CERTIFICATE OF CORRECTION

PATENT NO. : 6,872,257 B2
DATED : March 29, 2005
INVENTOR(S) : Martens et al.

It is certified that error appears in the above-identified patent and that said Letters Patent is hereby corrected as shown below:

Column 5,
Line 62, “in one contact” should read -- in at least one of said --

Column 6,
Line 2, “head (13).” should read -- head (12). --
Line 6, “(15) on the scraper” should read -- (15) and the scraper --
Line 44, “scraper head facing” should read -- scraper head (12) facing --
Line 67, “displacement element can” should read -- displacement element (15) can --

Column 8,
Line 4, “displacement element” should read -- displacement element (15) --

Signed and Sealed this

Seventh Day of June, 2005

JON W. DUDAS
*Director of the United States Patent and Trademark Office*